United States Patent [19]

Maekawa

[11] Patent Number: 4,659,207

[45] Date of Patent: Apr. 21, 1987

[54] COPYING METHOD AND APPARATUS FOR INDEPENDENTLY SCANNING TWO PARTS OF AN ORIGINAL DOCUMENT

[75] Inventor: Yoshikazu Maekawa, Hachioji, Japan

[73] Assignee: Konishiroku Photo Industry Co., Ltd., Tokyo, Japan

[21] Appl. No.: 757,783

[22] Filed: Jul. 22, 1985

[30] Foreign Application Priority Data

Jul. 28, 1984 [JP] Japan ..... 59-158105

[51] Int. Cl.[4] ..... G03G 15/00

[52] U.S. Cl. ..... 355/8; 355/3 R; 355/7; 355/24; 355/25

[58] Field of Search ..... 355/3 R, 8, 7, 46, 14 R, 355/11, 24, 25

[56] References Cited

U.S. PATENT DOCUMENTS

| | | | |
|---|---|---|---|
| 4,110,023 | 8/1978 | Silverberg | 355/46 X |
| 4,268,164 | 5/1981 | Yajima et al. | 355/7 X |
| 4,303,332 | 12/1981 | Sakai | 355/7 X |
| 4,353,638 | 10/1982 | Knechtel | 355/46 X |
| 4,451,136 | 5/1984 | Tanioka et al. | 355/7 X |

*Primary Examiner*—A. C. Prescott

*Attorney, Agent, or Firm*—Jordan B. Bierman

[57] ABSTRACT

A copying apparatus wherein a document consisting of a first half side and a second half side can be scanned by a scanning member independently corresponding to the area of the first and second half sides. These copies are formed on the both sides of a copy paper or on two different copy papers selectively.

8 Claims, 12 Drawing Figures

COPYING METHOD AND APPARATUS FOR INDEPENDENTLY SCANNING TWO PARTS OF AN ORIGINAL DOCUMENT

BACKGROUND OF THE INVENTION

This invention relates to a method of automatically making a copy of an original document recorded on two leaves spread side-by-side such as a book, in the use of a copying apparatus such as an electrophotographic copying apparatus, and the apparatus for use in such method.

In order that some consecutive pages of a book-like original may be copied by making use of a conventional type copying apparatus in such a manner that two pages of the book spread side-by-side may be copied at a time and then after turning over one of the pages of the original, the rear page thereof and the next page thereto may successively be copied together and tne resulting copied copy paper may be put in order of the pages. it is required to cut in half every copy paper made thereon a copy of every two pages and to put them in order of the pages again. Particularly. it will require much time and labor to make copies of a great number of original documents in succession and to cut a great number of the copy paper to put them in order to the pages. There may also be some instances where the pages may possibly put in disorder and resultantly the documents may be wrongly filed.

With the purpose of avoiding the above-mentioned disadvantage, there has been proposed such a method that the one side of a book-like original is copied by placing it in the fixed position on the original glass plate of a copying apparatus, and another side thereof is copied by following the same way again. This method will also require much time and labor, because the frequency of handling the original is increased.

Now, in the case that an original document is printed on both sides of every leaf, as is similar to the pages of tne ordinary type of books, how to make the duplex copies of such consecutive pages is that;

(1) a book is opened and the first page of the original document to be copied is placed in the fixed position on an original glass plate, (2) the copy is made on one side of the first copy paper in the initial copying cycle, (3) next, the second page of the original is placed in the above-mentioned fixed position on the original glass plate. In the course of this time, the first copy paper is reversed and is then transported to stand by in a paper feed position, (4) in the second copy cycle, the first copy paper is copied on the rear side thereof and is then delivered from the apparatus, and (5) in succession, the above-mentioned first and second cycles are repeated to make copies of the third and subsequent pages.

As in the above-mentioned steps. a half portion of the original glass plate is set as the fixed area and each page of the original document is placed therein one after another to start the respective copying operation.

In the cases as mentioned above, a two-page-spread-original such as a book placed on an original glass plate should be moved to the fixed position every time when each page is copied.

Generally speaking, as shown in FIG. 4, there are two types of books, i.e, one is of the left-opened type and another is of the right-opened type. In either types, it is common that the front surface of every leaf is put with an odd pagination and the rear surface thereof is put with an even pagination.

On the other hand, when having made a copy with a copying apparatus, it has so far been carried out in most cases by one-side copying methods by reasons of the complicated operation. maintaining of orderly pagination, intricacy in the apparatuses, large-sized apparatuses and the like. Accordingly, there are demands for a duplex copying system from the viewpoint of the economization of transfer paper, space shortage for storing records, or the format and weight of a book to be copied, and the like. There have already been proposed a number of duplex copying apparatuses. For example, there have been proposed those described in Japanese patent O.P.I. Publication No. 137341/1977 and the like, and further, another duplex copying operations may be referred to Japanese patent application No. 85103/1983 and the like.

As an example of the image transfer type copying apparatus capable of duplex copying. there are put in practical use such a system that an ordinary copying operation is made over one side of copy paper and the copy paper completed thereon the copying operation is introduced into the original or the 2nd paper feed unit again and is then reversed and fed again to the copying apparatus so as to make a copy on the surface of the copy paper as was made on the front surface.

As for the method of duplex copying a book, such as described above, the method disclosed in Japanese patent 0.P.I. publication No. 36951/1076 is well-known. However, this method has such a disadvantage that a book original should be placed up-side-down depending on whether tne book is of the left-opened type or of the right-opened type, because it is required that the original glass plate surface is to be divided into two portions so that the original in a desired copying size should be placed on the corresponding divided portion of the original glass plate.

This invention is proposed by taking the above-mentioned circumstances into consideration. When making duplex copies of consecutive originals recorded on the both sides of every leaf such as a book-like original, there are apt to cause troubles and errors in copying operation if taking such a method that copy is made by moving every page of the original. In every daily life, there are used either of the left-opened and right-opened books. It will therefore cause an operator an error to selectively place a book in order or upside down so as to correspond to the left- or right-opened type of book.

OBJECT AND SUMMARY OF THE INVENTION

It is an object of the invention to provide a method of automatically making copies of a two-side original document comprising two pages spread side-by-side, such as a book, on one surface or both surfaces of a sheet of copy paper, and to provide the apparatuses for use in such method.

The above-mentioned object of the invention can be achieved by a method of copying a two-side original document, in which a book-like original document to be copied is spread and placed on an original glass plate haVing an area for two sides of a desired copying size. and a mode is so made switchable as to start an exposure from either one end or the center of the original glass plate according to an operation signal for determining whether the book-like original document is of the left-opened type or right-opened type, and the object of the invention can be achieved as well as by the apparatus for use in such method.

DETAILED DESCRIPTION OF THE INVENTION

Now, the examples of the invention will be described in detail with reference to the accompanying drawings:

EXAMPLE 1

Figure 1:
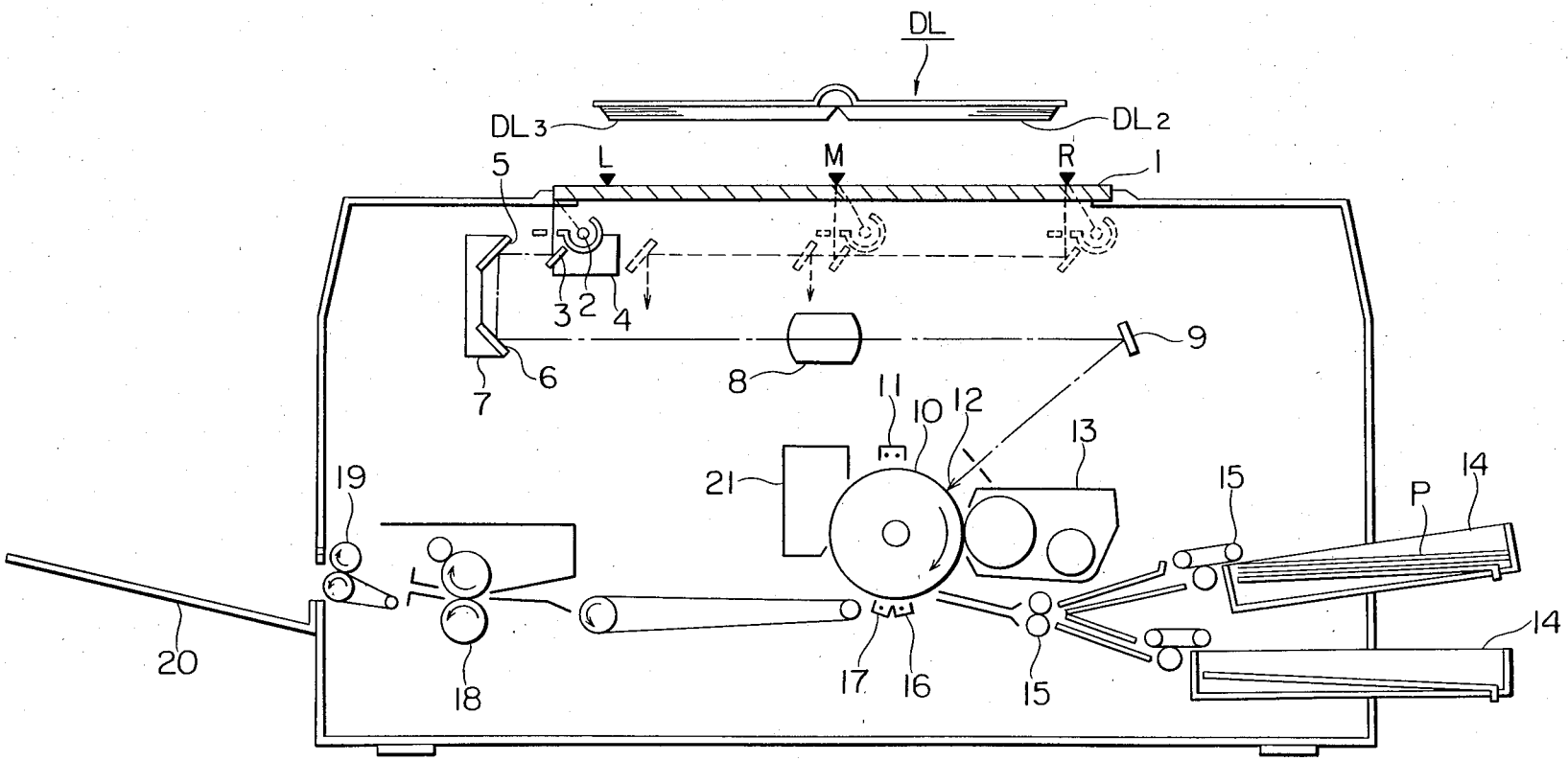
FIG. 1. is a sectional view of an example of the duplex copying apparatuses relating to the invention.
Figure 2:
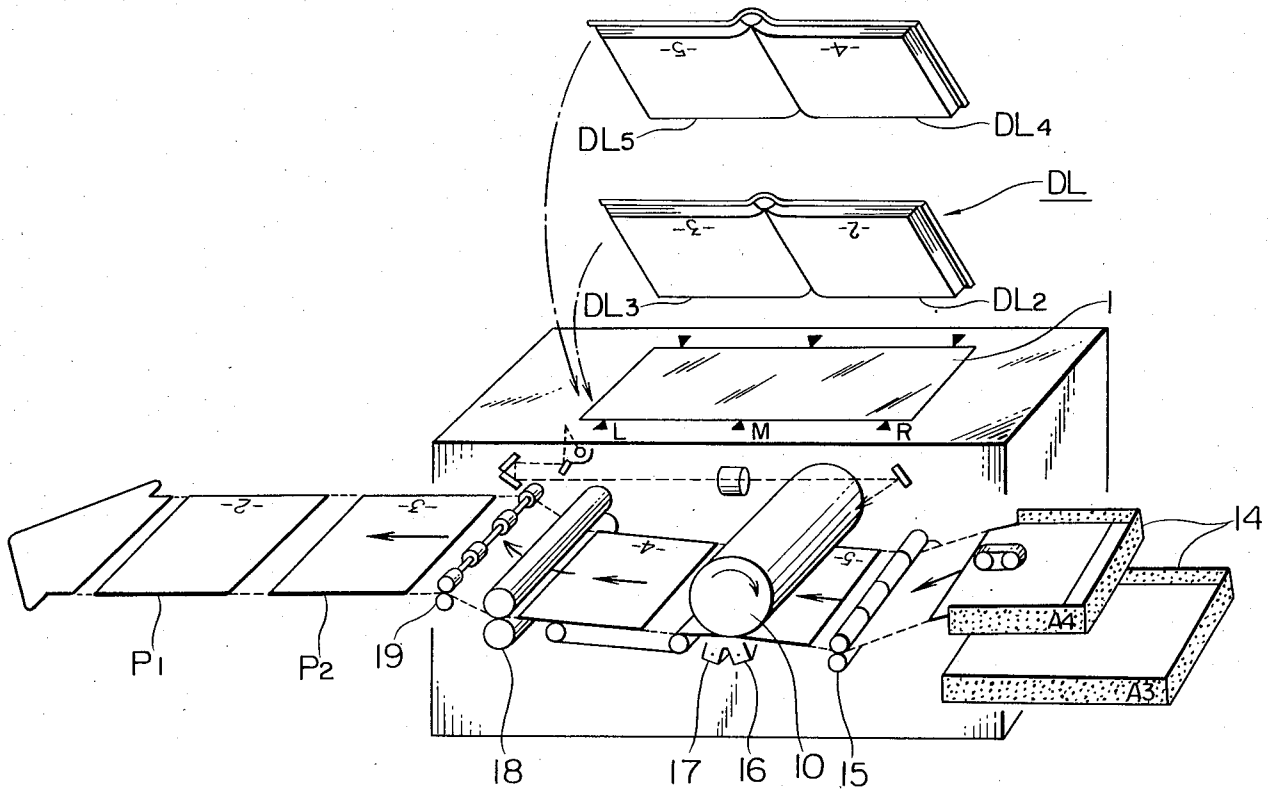
FIG. 2 is a schematic illustration of the copy paper feed path for the apparatus shown in FIG. 1.
Figure 3:
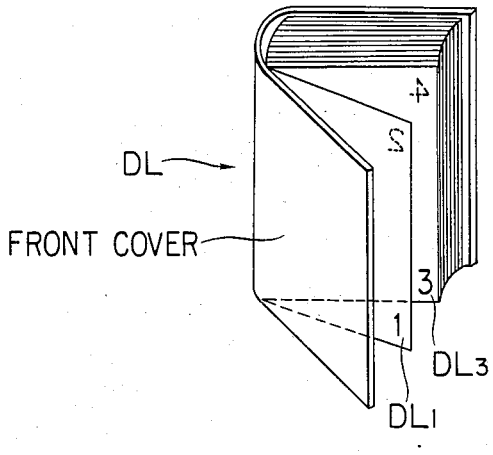
FIGS. 3 (*a*) and 3 (*b*) are perspective illustrations of a left-opened type book-like originnal document and a right-opened one, respectively.
Figure 3:
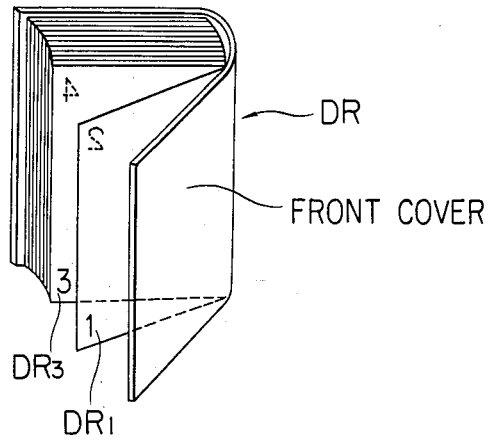

FIG. 1 is a schematic cross section of a two-side original document copying apparatus relating to the invention; FIG. 2 is a schematic illustration of the copy paper feed path; FIG. 3(*a*) is a perspective view of a left-opened book-like original document (hereinafter called a book original); and FIG. 3(*b*) is a perspective view of a right-opened book original.

Figure 4:
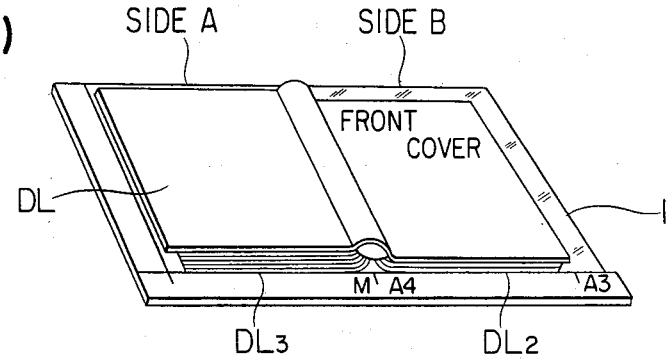
FIGS. 4(*a*) and 4(*b*) are perspective illustrations of the states where each of the book-like original documents is placed,. on original glass plates, respectively.
Figure 4:
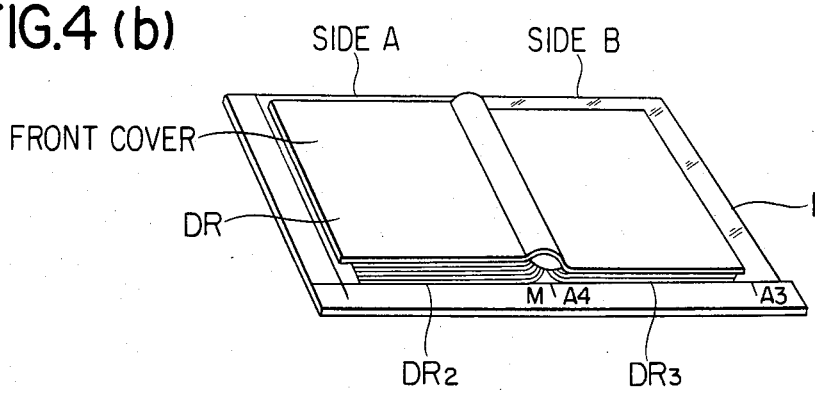

In the drawings, D is a book original wnich is a matter to be copied, and the pages thereof are spread and placed on original glass plate 1 so as to copied. FIG. 4(*a*) is a perspective view showing a state where a left-opened book original DL is placed on original glass plate 1 so as to be copied; and FIG. 4(*b*) is a perspective view showing a state where a right-opened book original DR placed on original glass plate 1. In FIGS. 1 and 2, the first page $DL_1$ of left-opened book original DL is placed on the right side of the center M of the original glass plate 1 and the second page $DL_2$ on the right side thereof, so as to be copied.

Underneath the original glass plate 1, there are provided with primary mirror unit 4 attached with an exposure lamp 2 for irradiating the original DL and primary mirror 3 and secondary mirror unit 7 attached with secondary mirror 5 and tertiary mirror 6 so that these units may be linearly reciprocated on the plane parallel to the original glass plate 1. The original DL is slit-exposed and focused on photoreceptor drum 10 through lens 8 and quaternary mirror 9 while the optical path is equally kept by primary mirror 4 and secondary mirror 7 traveling in the same direction with that of primary mirror 4 at a half of the traveling speed of primary mirror 4.

The surface of the photoreceptor drum 10 is covered witn a photoelectroconductive layer. This photoreceptor drum 10 is positively charged at first by electric charger 11 to which high voltage current is supplied from a high tension power source. In succession, when reaching exposure section 12, the original DL placed on original glass plate 1 is irradiated by exposure lamp 2 and is then focused on photoreceptor drum 10 through the mirrors 3, 5 and 6, lens 8 and mirror 9, and then the electrostatic latent image thereof is formed.

When this electrostatic latent image reaches developing unit 13, it is developed to make it visible and then to form a toner image.

Next, a sheet of copy paper P fed from a paper feed cassette I4 is fed further by paper feeding unit 15 and is then brought into close contact with photoreceptor drum 10. At this point of time. transfer electrode 16 applies a high tension voltage from the high tension power source to the copy paper P and then transfers the toner image formed on the photoreceptor drum 10 onto the copy paper P.

The copy paper P on which the toner image was transferred is separated from the photoreceptor drum 10 by a separation electrode 17 and is then introduced into fixing unit 18. The toner image is fixed by the fixing unit 18 on the copy paper P and the copy paper P is then delivered by paper delivery roller to a copy delivery tray 20 or sorter.

On the other hand, toners remaining on photoreceptor drum 10 are cleaned up by cleaning unit 21 and may then be able to repeat the successive copying cycles.

Figure 5:
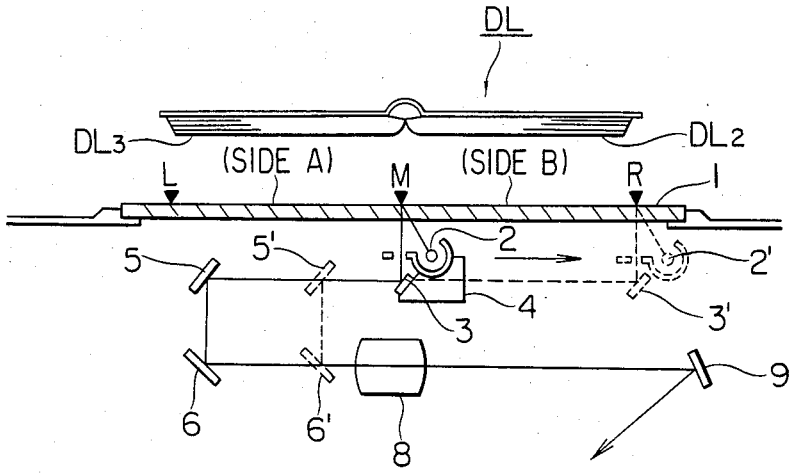
FIGS. 5 (*a*) and 5 (*b*) are elevational cross sections showing the operations of optical systems for scanning at the time when two-side original documents are copied, respectively.
Figure 5:
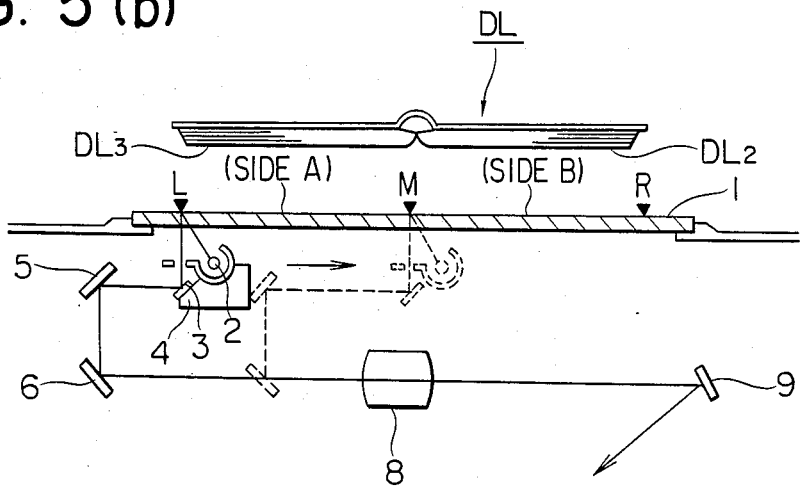

According to the structure described above, a method of copying a two-side original document relating to the invention will now be described:

At first, a method of copying a left-opened book original such as shown in FIG. 3(*a*) will be described. FIG. 4(*a*) is a perspective illustration of such a state where the left-opened book original DL in size of, for example, A4 is placed on original glass plate 1 having the glass area capable of covering two-pages spread side-by-side. FIG. 5 is an elevational cross section describing the operation of a scanning optical system.

In this example, the original glass plate is of the size capable of covering a A3 size. The description of this example will be made by taking the case of copying an A4 size book on a sheet of A4 size copy paper.

In the description of original glass plate 1, the center M thereof forms the boundary between the left side (L-M) hereinafter called Side A of the original glass plate 1 and the right side (M-R) hereinafter called Side B. In other words, two A4 size original can be placed on the original glass plate 1.

In a left-opened book original DL. the face of the first leaf is paginated by page 1, the back of the first leaf by page 2, the face of the second leaf by page 3 and the back of the second leaf by page 4, respectively. Therefore, the faces of every leaf are paginated by odd pages. Hereinafter the face of every leaf (i.e., odd pages) is called Side A, and the back thereof is called Side B. These Sides A and B will be described so as to correspond to Sides A and B of the aforementioned original glass plate 1.

Figure 6:
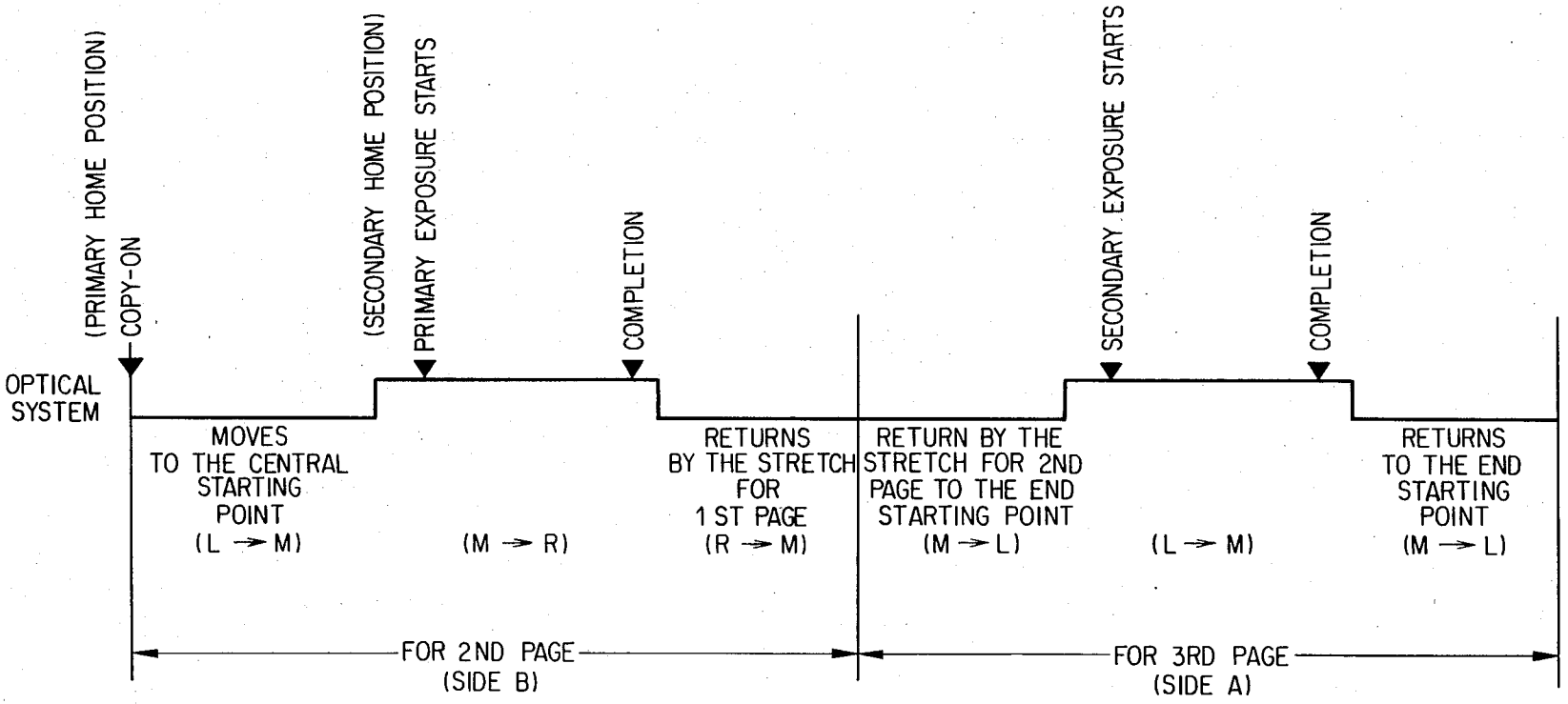
FIG. 6 is a timing chart of the optical system.

For the convenience of describing the copying steps of a left-opened book original DL, the description will now be made about the state that the 2nd and 3rd pages of the book original DL are spread out. (See the timing chart shown in FIG. 6)

First, a left-opened book original should be confirmed and a size of transfer paper snould be determined. When a copying button is turned ON, primary mirror unit 4 of a scanning optical system will travel from the primary home position indicated by a solid line in FIG. 1 to the 2nd home position located on the slightly left side of the center position M of original glass plate 1, and successively it will enter the exposure step for the 2nd page $DL_2$ of the book original DL placed on the side B of original glass plate 1 to make a scanning of the length of the transfer paper size (M-R), and when it comes to Point R at which the exposure will be completed, it will stop once. While the primary mirror unit 4 is travelling, the 2nd mirror unit 7 also travels along the steps thereof at a half of the speed of the primary mirror unit 4.

On the other hand, transfer paper $P_1$ is fed out from paper feed cassette 14 with a timing regulated by the aforementioned operation signal and is fed to transfer electrode 16, and is then put into the fixing and delivery steps to be ejected to the outside of the apparatus. Thus, the copying operation of the Side B is completed.

In succession, according to the above-mentioned established operation signal, the scanning optical system will reverse its travelling direction from Point R and will return to the primary home position after passing through Point M. Next, the scanning optical system will reverse again to travel from Point L to Point M and will then scan over the 3rd page $DL_3$ of the book original DL placed on the Side A of the original glass plate 1. Thereby, the copy image of the 3rd page $DL_3$ of the book original DL is formed on the 2nd transfer paper $P_2$ and the paper $P_2$ will be ejected. Thus, the copying operation is completed.

By an optical scanning of original surfaces in such a copying mode as mentioned above, transfer paper $P_1$ formed thereon the copy image of the 2nd page of an original document and, next, transfer paper $P_2$ copied thereon the 3rd page of the original document are ejected one after another.

Then, by turning over the pages, the 4th page $DL_4$ and the 5th page $DL_5$ of the book original DL can also be copied in the same mode and are then orderly ejected. It is, therefore, readily possible to make a file.

FIG. 3(*b*) shows a perspective view of a right-opened book original DR; and FIG. 4(*b*) is a perspective view showing the state that the book original DR is placed on original glass plate 1. In the case of copying right-opened book original DR with spreading the pages, the 2nd and 3rd pages thereof are placed on Side A and Side B of original glass plate 1. Therefore, when setting the mode of right-opened book original DR and depressing a copying button, an exposure and scanning operations are started at first, according to the operation signal, from the primary home position over the 2nd page $DR_2$ of the original DR placed on Side A so as to form a copy image and are then stop once at the center point M. After then, the scanning optical system will travel to the 2nd home position and while it is travelling, the primary copying cycle will be completed. And, in succession, the secondary copying cycle will be carried out from the 2nd home position.

Indicator M for showing the center position of a matter to be copied may be fixed to an indicator plate provided to the outside of original glass plate 1. It is also allowed to provide the center position M to be adjustable according to the sizes of transfer paper. In the latter case, the driving mechanism of a scanning optical system can be simplified by such a manner that the left end of the original glass plate 1 is to serve as the position setting guide for a book original and both of the center position M and the 2nd home position are adjusted in positions according to original sizes.

Figure 7:
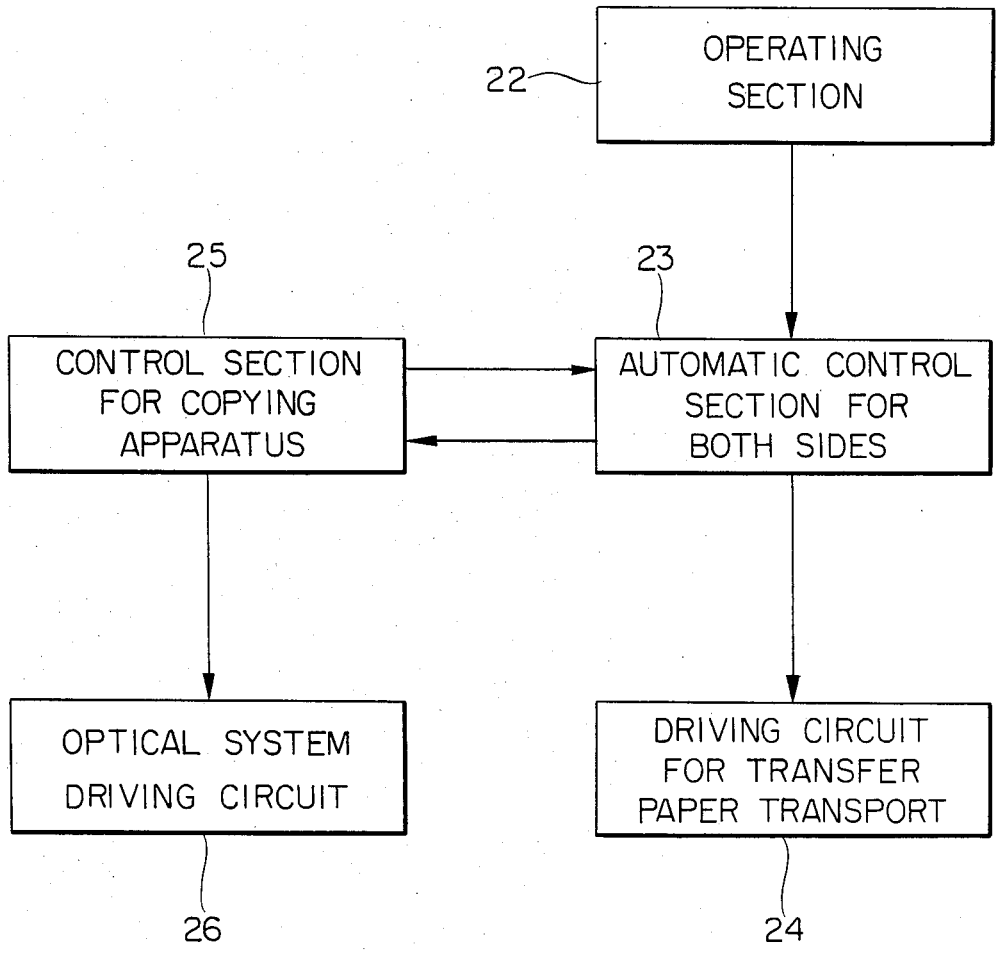
FIG. 7. is a flow diagram of the control system for copying a two-side original document.

FIG. 7 illustrates a control system in the case of copying the above-mentioned both side of an original, wherein 22 is an operating section for selecting the following operations on an operation panel:

(1)
- (a) Each page of an original document of two-page spread is copied on a separate sheet of transfer paper,
- (b) an original documents of two-page spread is copied at the same time on one sheet of transfer paper,
- (c) only an original document placed on Side A of the original glass plate is copied, or
- (d) only an original document placed on Side B of the original glass plate is copied.

(2) In the case of copying one page after another to make a two-page copy, a mode of left-opened book original DL or right-opened book original (CDR) is selected by a switch, so as to set an original size to be copied.

According to an operation signal given from this operating section 22, a both-side copying operation is controlled by a control section 23, and a selection of transfer paper P and the drive of paper feed timing are carried out by a driving circuit for copy paper transport 24. On the other hand, a copying apparatus is controlled by a control section for copying apparatus 25 through the control section 23, and the scanning optical system circuit 26 is then driven and controlled, so that a prescribed primary home position, secondary home position and reversing position are controlled.

EXAMPLE 2

Next, a method of copying a book original on the front and back surfaces of a sheet of transfer paper (hereinafter called a duplex copying) will now be described with reference to FIG. 8.

The book original is to be placed on an original glass plate as shown in FIGS. 4(*a*) and 4(*b*).

Figure 8:
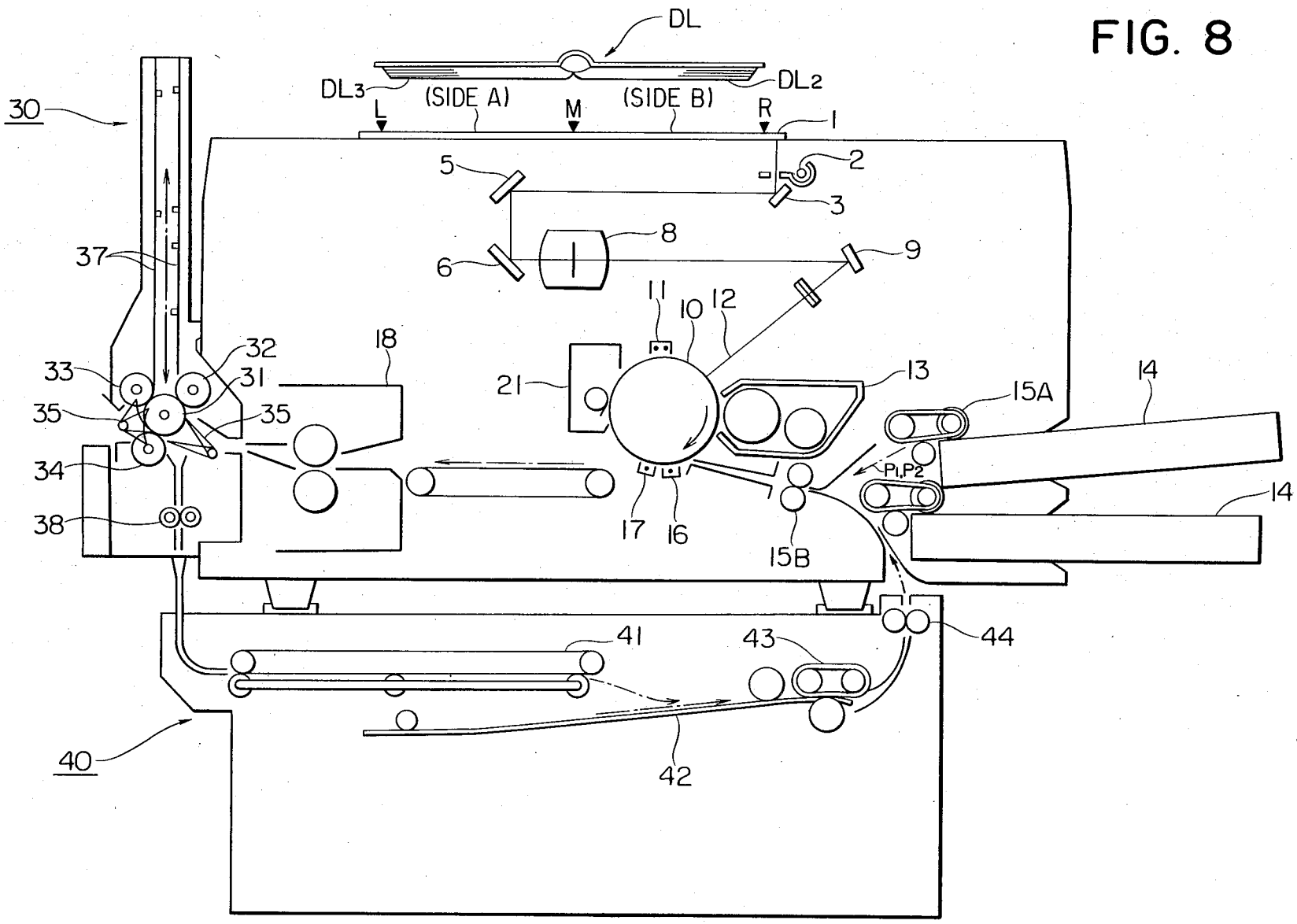
FIG. 8 is a schematic structural drawing of a duplex copying apparatus.

FIG. 8 is a schematic structural drawing of a duplex copying apparatus comprising the aforementioned copying apparatus to which a copy paper reversing unit 30 and copy paper transport unit. In the drawing, like parts are shown by corresponding reference characters given in FIG. 1.

Figure 9:
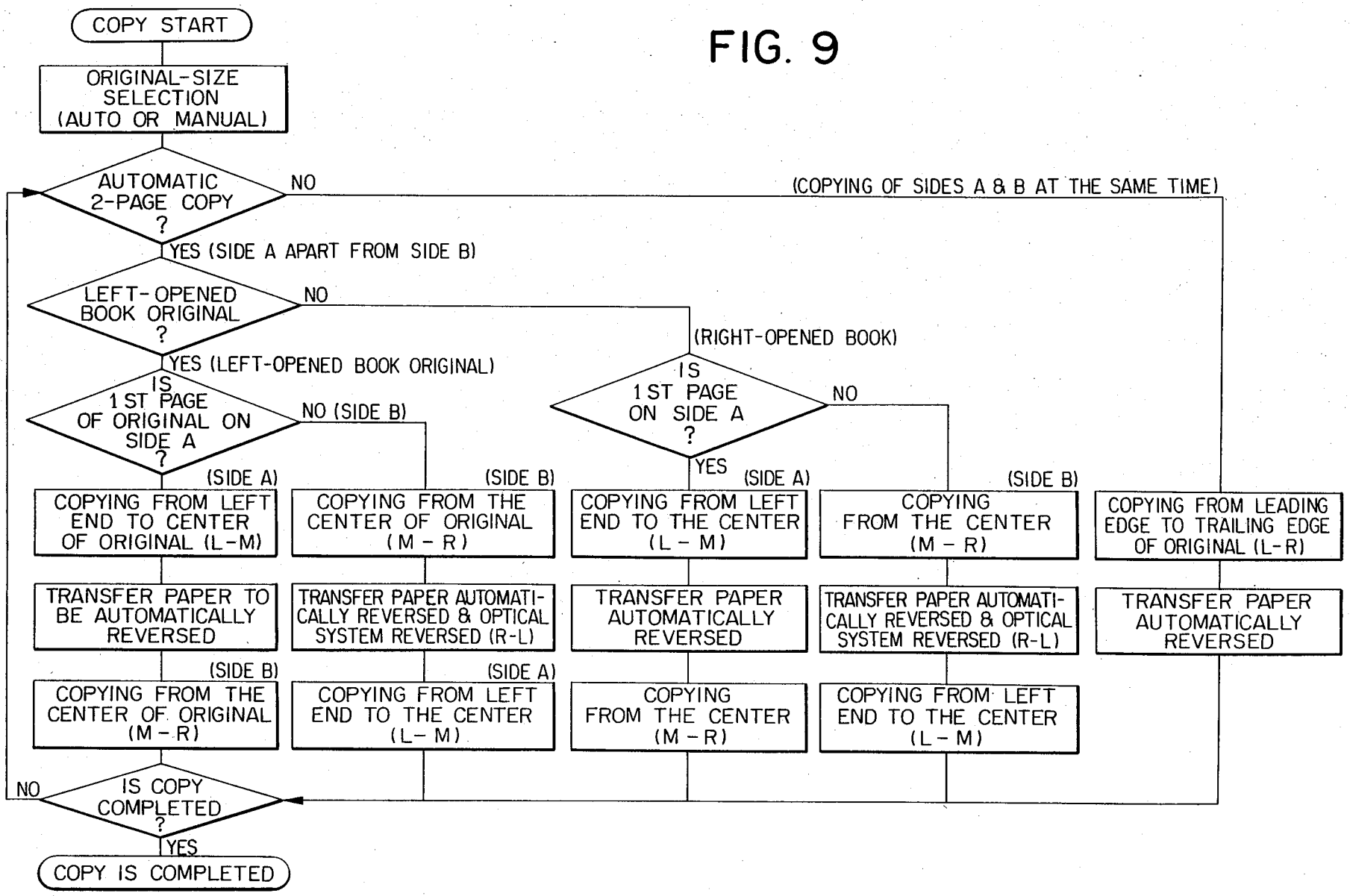
FIG. 9 is a flow-chart of a book-like original document copying operation.

FIG. 9 is a flow-chart illustrating the operation of duplex copying a book original.

At first, in making a copy of a book original to be copied, the modes of the original are selected to properly set, namely, the size of the book original is automatically detected or manually set, and a determination is set on whether each page of two-page original is to be copied on the respective side of a sheet of copy paper or the two-pages of the original is to be copied at the same time on one side of a sheet of copy paper, and when making a copy page by page a mode of left-opened book original or right-opened book original is to be set, and further a determination is to be set whether the first page of the original should be placed on Side A or Side B of the original glass plate.

After setting the above-mentioned modes, and when the copy start button is depressed, the optical system will travel and copy paper will be fed automatically according to the prescribed program, and a duplex copy will be made and ejected.

Now, a series of processes for making duplex copies from the first page to the third page in the order of the steps, taking the case of using such a book original as shown in FIG. 3(*a*), as an example of the operations for making duplex copies of a book original embodied in accordance with the above-mentioned Example 2.

(Step 1)

As shown in FIG. 3(*a*), the first page of a left-opened book original is opened, and as shown in FIG. 4(*a*), the first page $DL_1$ is placed on the Side A of an original glass plate 1. When a copy start button is depressed to start to make a copy after setting the necessary modes, an optical system will scan from the left end L to the center M and the image of the first page $DL_1$ of the original DL placed on the Side A of the original glass plate 1 is formed on a photoreceptor 10 according to the above-mentioned toner image forming process.

On the other hand, copy paper $P_1$ of the prescribed size is fed out from cassette 14 by paper feed roller 15A to resist roller 15B and the paper $P_1$ will stop to stand by. Next, the resist roller 15B is driven by a signal given from the optical system, so that the copy paper $P_1$ can be fed to transfer electrode 16 by synchronizing the drive of resist roller 15B with the above-mentioned toner image forming process. In this stage, the toner image of Side A formed on the photoreceptor 10 is transferred to the surface of copy paper $P_1$ and transported to a fixing unit 18 by a conveyor belt so as to be thermally fixed by a heat roller. The copy paper $P_1$ which was fixed and ejected will then go through a paper reversing unit 30.

Such paper reversing unit 30 comprises a main roller 31 capable of revolving back and forth, a primary sub-roller 32, secondary sub-roller 33 and tertiary sub-roller 34 which are driven by the revolution of the main roller 31, switching members 35 and 36 for switching the transport paths of copy paper, a shooter 37 for making the copy papers switch-back, and transport roller 38.

Underneath the copying apparatus body, there is provided with a paper transport unit 40 and there are also arranged with a conveyor belt 41, a stacker 42, a retransport roller 43 and a conveyor roller 44 which are used for conveying the copy papers ejected from the above-mentioned paper reversing unit 30.

Copy papers $P_1$ ejected from the aforementioned fixing unit 18 are ascended inside the shooter 37 by the counterclockwise revo ution of switching member 35 and main roller 31 according to the signals generated in a prescribed mode. After then, the copy paper $P_1$ is switched back to decend inside the shooter 37 and is passed by the secondary sub-roller 33 and tertiary sub-roller 34 by the main roller 31 and the switching member 35, and is then entered in the paper transport unit 40 through the conveyor roller 38.

The copy paper $P_1$ is conveyed from this point by conveyor belt 41 so as to be placed on tne stacker 42 which is an intermediate paper stacking section.

(Step 2)

One leaf of book original DL is turned over, and the 2nd page that is the back side of the first page and the 3rd page thereof are placed on the Side A and Side B of original glass plate 1, respectively.

Thereafter, the copy start button is depressed when the copying apparatus is stopped in operation, so that a copying operation is to be commenced. Thereby, copy paper $P_1$ placed on the stacker 42 is transported to resist roller 15B by feed roller 43 and conveyor roller 44, and the copy paper $P_1$ is in the state of standing still for standing by.

On the other hand, the optical system scans over the Side B covering the area from the center position M to the right end R so as to form a toner image on the photoreceptor drum 10 in the same manner as mentioned before. Then, the resist roller 15B is driven by a signal given from the above-mentioned image forming process so that the copy paper $P_1$ may be ejected to the outside of the apparatus through the successive transfer, separation and fixing steps. In other words, the copy paper $P_1$ is recorded with the first page of the original on the front side and the 2nd page on the back side, respectively, and is then ejected.

After scanning over the 2nd page, the optical system is reversed from the position R to reach the position L at the left end, and then scans over tne Side A. Synchronizing with this scanning operation, the 2nd copy paper $P_2$ is drawn out from cassette 14 to form an image on the Side A, and is then placed on the stacker 42 of the paper transport unit 40 through the paper reversing unit 30.

In the same manner, the 4th page, 5th page and thereafter will be copied, and the duplex copied corresponding to each page of the book original can be obtained.

If a series of copying operations is not needed to continue at the point of time when the 3rd page is copied, for example, the paper feed roller 43, conveyor roller 44, resist roller 15B, photoreceptor drum 10 and main roller 31 are driven regardless of any exposure operation, and thereby the copy paper placed on the stacker 42 will be ejected with the back side up to the outside of the apparatus.

In the above description, there gives an embodiment in which a series of duplex copies is operated one after another from the first page of a left-opened book original DL. It is, however, readily possible to operate a series of duplex copies each of two-page spreading leaves from the 2nd page on by setting the initial mode.

It is a matter of course that a right-opened book original DR can be copied in the same manner.

In the above described embodiment, a book original is described, however, the invention shall not be limited thereto, but such original can also be of the one-side or both-side printed sheet types. In the case of such sheet type originals, an automatic original transport unit can jointly be used. In this case, the same operation as in the case of a book original can be carried out by continuously transporting two-page originals. And, in the case of making a plurality of duplex copies, such duplex copies can be made rapidly in the manner that a desired number of copies of Side A mentioned in Step 1 is continuously made and the copy papers are stacked on stacker 42, and then the same number of copies of Side B in the Step 2 as the number of the copy papers placed on the stacker is made.

As described above, when placing a book original with spreading a leaf on an original glass plate having an area of two sides of a copy size required to be copied, every page of a two-side area can be automatically copied by a single action. In particular, when making a duplex copy on a copy paper, the copies can be made in the same manner as in the case of a duplex printed book original and can be ejected in order. Therefore, the effects can be displayed, such as that a filling can readily be made, the copying efficiency can sharply be multiplied, and the operability can also remarkably be improved.

What is claimed is:

1. A method of copying an original document wherein said original document, placed on an original glass plate, is optically scanned by a movable scanning means, said method comprising: optically scanning a first half side of the original document corresponding to the downstream side in said scanning direction, forming a copy of the first half side on a copy paper, and optically scanning the second half side of the original document independently of said scanning of said first half side to obtain a copy thereof.

2. The method of claim 1, further comprising forming a copy of the second half side on the opposite surface of said copy paper from the first half side.

3. The method of claim 1, further comprising forming a copy of the second half side on another sheet of copy paper.

4. A copying apparatus comprising:

an original glass plate for supporting an original document, optical scanning means for scanning said document in a scanning direction, a primary scanning mode wherein a second half side of the document corresponding to the upstream side relative to said scanning direction is scanned by said scanning means to obtain a copy of said second half side, and the first half side of the document is scanned by said scanning means which operates independently of the scanning operation for said second half side, to obtain a copy of said first half side after scanning said second half side, a secondary scanning mode wherein a first half side of the document corresponding to said upstream side is scanned by said scanning means to obtain a copy of said first half side, and the second half side of the document is scanned by said scanning means, which operates independently of the scanning operation for said first half side, for obtaining a copy of said second half side after scanning said first half side, and a scanning mode switching means by which one of the primary scanning mode and the secondary scanning mode is selected.

5. The apparatus of claim 4, further comprising a switching means for selecting between a whole size copying mode wherein the whole size of said document is copied on one side of a copy paper and a two-paper copying mode which consists of said primary scanning mode and said secondary scanning mode.

6. The apparatus of claim 5 wherein said copies of said first half side and said second half side are formed on different sheets of copy paper.

7. The apparatus of claim 5 wherein said copies of said first half side and said second half side are formed on both sides of a single sheet of copy paper.

8. The apparatus of claim 5, further comprising a copy mode switching means for selecting a primary copying mode wherein said copies of said first half side and said second half side are formed on different sheets of copy paper, and a secondary copying mode wherein said copies of said first half side and said second half side are formed on both sides of a single sheet of copy paper.

* * * * *